US007007326B2

(12) United States Patent
Tsiarkezos

(10) Patent No.: US 7,007,326 B2
(45) Date of Patent: Mar. 7, 2006

(54) PACKAGE FOR SKIRT MATERIAL OF A FITTED COVER

(75) Inventor: Stephen Horace Tsiarkezos, Elkton, MD (US)

(73) Assignee: Xymid, L.L.C., Chesterfield, VA (US)

( * ) Notice: Subject to any disclaimer, the term of this patent is extended or adjusted under 35 U.S.C. 154(b) by 155 days.

(21) Appl. No.: 10/444,755

(22) Filed: May 24, 2003

(65) Prior Publication Data

US 2004/0231054 A1 Nov. 25, 2004

(51) Int. Cl.
*A47G 9/04* (2006.01)

(52) U.S. Cl. ..... 5/497; 5/499

(58) Field of Classification Search ..... 242/160.4; 5/499, 497

See application file for complete search history.

(56) References Cited

U.S. PATENT DOCUMENTS 1,772,958 A * 8/1930 Moore ..... 139/101
4,148,441 A * 4/1979 Cohen ..... 242/160.4
4,495,233 A * 1/1985 Bassetti ..... 428/81
4,642,826 A * 2/1987 Bassetti ..... 5/496
4,985,953 A * 1/1991 Seago ..... 5/497
5,056,441 A * 10/1991 Seago ..... 112/2.1
5,249,322 A * 10/1993 Seago ..... 5/499
5,603,132 A * 2/1997 Zafiroglu ..... 5/497
6,199,231 B1 * 3/2001 Zafiroglu ..... 5/497
6,272,701 B1 * 8/2001 Zafiroglu ..... 5/499

* cited by examiner

*Primary Examiner*—Kathy Matecki
*Assistant Examiner*—Sang Kim
(74) *Attorney, Agent, or Firm*—Jeffrey C. Lew; Lawrence Isakoff

(57) ABSTRACT

A wound-up cylindrical package is provided of a substantially non-stretchable fabric that has edge regions in which different amounts of elastic elements are incorporated. The fabric is subsequently removed from the package without excessive gathering or twisting for convenient use as a skirt material in the fabrication of a fitted mattress cover.

8 Claims, 2 Drawing Sheets

PACKAGE FOR SKIRT MATERIAL OF A FITTED COVER

BACKGROUND OF THE INVENTION

1. Field of the Invention

This invention relates to a substantially non-stretchable fabric having an edge region that is gathered by elastic elements incorporated in the edge region. More particularly, the invention concerns a package of such fabric wound up on a cylindrical core and its subsequent use as a skirt for a fitted mattress cover.

2. Description of the Prior Art

It is well known to provide fabric packages in which a length of fabric is wound around a cylindrical core. Such conventional packages seldom present problems, as long as the fabric is uniform across its width and the opposite edges of the fabric are of equal length. However, problems are encountered when attempting to provide such packages for fabrics that have a gathered edge region. For example, Cohen, U.S. Pat. No. 4,148,441, describes a special package for winding a fabric that has a gathered edge region. The gathered edge region is formed by longitudinally extending elastic threads sewn under tension into that edge region, so that when the tension is removed, the edge into which the threads were stitched becomes gathered and substantially shorter than the opposite edge region in which there no such threads. Such fabric is used for example to make apparel skirts which have gathered stretchable waist regions. Cohen discloses a wound-up package of such fabric comprising a core which has opposed free end regions that are of different diameters and a tapered region between the regions of different diameter. The core includes tubular and finned portions. The core end region which is of the greater maximum dimension supports the fabric at its longer edge region.

A problem similar to the one addressed by U.S. Pat. No. 4,148,441 is encountered in the manufacture of certain fitted covers for mattresses. Most fitted mattress covers have a top panel of quilted or padded material, and a fabric skirt which is attached to and depends from the top panel. Typically, an elastic band is stitched under tension into the lower edge of the skirt to form a gathered lower edge region. The elastic band has sufficient tension to pull the skirt material under the mattress when the mattress cover is fit onto a mattress. However, in manufacturing and handling such skirt fabric, the fabric gathers along one edge of the fabric and become very difficult to wind evenly on a cylindrical core. Instead of a neat flat edged cylindrical windup, as is obtained with a uniform fabric, the wound-up fabric with one elastic edge region becomes "telescoped". To avoid the telescoping problem, it has been a common practice in the manufacture of mattress covers to (1) prepare a wound-up roll of skirt material without any elastic edge region, (2) slit the material to appropriate width, and then (3) incorporate the elastic in the lower edge region as the material is unwound from the roll. However, when the resulting skirt fabric with such an elastic lower edge region is fed for attachment to the top panel to form a fitted mattress cover, the skirt material twists, deforms and rolls out of plane, which make attachment of the upper edge of the skirt to the top panel very difficult to accomplish neatly. The above-described problems are particularly evident when inexpensive conventional non-elastic fabrics are employed for the skirt material. Because of these problems in providing a uniformly wound-up skirt fabric having an elastic or gathered edge region, the cost and speed of manufacturing such fitted covers are detrimentally affected.

An aim of the present invention is to ameliorate the wind-up problems associated with skirt materials having a highly elasticized edge region and to decrease the costs of manufacturing fitted mattress covers.

SUMMARY OF THE INVENTION

The present invention provides package comprising a length of fabric wound up on a cylindrical core of uniform diameter, the fabric having one edge region that is highly elasticized. The fabric, which is particularly suited for use as the skirt of a fitted-mattress-cover, comprises a substantially non-stretchable bonded nonwoven fabric having an upper edge region, a lower edge region, and a mid-span region there-between, the fabric having a unit weight in the range of 30 to 120 g/m$^2$, preferably in the range of 40 to 70 g/m$^2$, and a stretchability in the length direction of less than 10%, preferably less than 5%, the lower edge region having elastic elements stitched therein under sufficient tension to extend the elastic elements to at least 200% of their not-tensioned length, and the edge region requiring a tensile load of at least 100 grams, preferably in the range of 300 to 1000 grams, to substantially remove any gathering of the edge when removed from the wound-up package, the upper edge region having elastic elements stitched therein such that the tensile load required to keep the lower edge region of the fabric from gathering and the fabric from twisting and rolling out of plane when removed from the wound-up package, is in the range of 2 to 15%, preferably 5 to 10% of the tensile load required to keep the lower edge region from gathering upon removal from the wound-up package the mid-span region having a width in the range of 7 to 20 inches 18 to 51 cm. Preferably, the lower edge region has a width in the range of 0.2 to 2 inch (0.5 to 5 cm), most preferably, 0.5 to 1 inch ( 1.3 to 2.5 cm), and the upper edge region has a width in the range of 0.05 to 0.5 inch (0.13 to 1.3 cm), most preferably 0.1 to 0.5 inch (0.25 to 1.3 cm).

The invention also provides a fitted mattress cover comprising a flat top panel of substantially non-stretchable material and a skirt that depends from the periphery of the top panel, the skirt being a bonded nonwoven fabric removed from the above-described package of the invention and having its upper edge region attached to the periphery of the top panel.

DETAILED DESCRIPTION OF PREFERRED EMBODIMENTS

Figure 1:
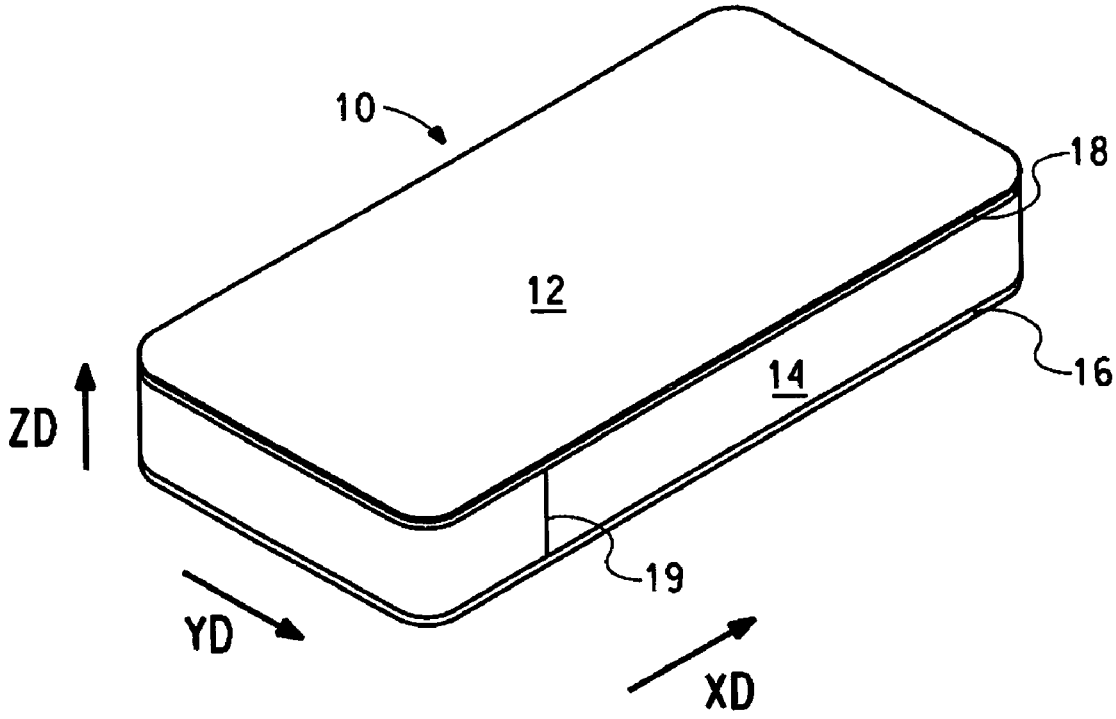
FIG. 1 is an isometric view of a mattress cover 10 in accord with this invention, the mattress cover having a flat top panel 12, a bonded nonwoven fabric skirt 14 attached to and depending from the top panel, the skirt having a highly elasticized lower edge region 16, a lesser elasticized upper edge region 18 and a seam 19.

The following description of preferred embodiments of the invention is included for purposes of illustration and is not intended to limit the scope of the invention. The scope is defined by the claims appended below.

For convenience and clarity, definitions will now be given of several terms and characteristics that are used herein to describe the invention Descriptions of the tests employed to quantitatively measure some of the characteristics follow the list of definitions.

"Upper edge region and/or lower edge region" refer to a region of the skirt fabric which extends in the longitudinal direction of the skirt and has elastic elements incorporated therein "Elastic" refers to the property of a filament or yarn to stretch when under tension and then, when the tension is released, to retract quickly and forcibly to its original to length.

"Spandex" is a manufactured elastic fiber formed from a long chain synthetic polymer that is comprised of at least 85% by weight segmented polyurethane. Typically, yarns of spandex are capable of elastic stretch of at least 300%, and often over 600%. Such yarns exert significant retractive force when in a stretched condition.

An "elastic combination yarn" is a yarn that has at least two dissimilar yarn components. Typically, one component is an elastic yarn (e.g., LYCRA® spandex, manufactured by E. I. du Pont de Nemours & Co.), and another component is a conventional or textured yarn of natural or synthetic fiber.

Conventional warp-knitting nomenclature is used to identify the various patterns employed in forming the elastic edge regions of the skirt fabric "Stretch force" is the tensile force (in grams) required to flatten (i.e., to remove the gathers) from an elasticized edge region of a skirt fabric The longitudinal stretchability (or stretchability in the length direction) of a skirt fabric is measured as follows. A longitudinal strip measuring 1-inch (2.5-cm) wide by 8-inches (20-cm) long, is cut from the skirt fabric parallel to the length direction of the fabric. A standard length of 2.5 cm, parallel to the long edge of the strip, is marked near the middle of the strip. The strip is clamped at opposite ends of a 5-cm length of the strip, with the initially marked 2.5-cm length centrally located between the clamps. The strip is then subjected to tension by suspending a 10-pound (4.54 kg) weight from the lower clamp. The load elongates the strip of skirt fabric and simulates the amount of pull that typically is exerted on skirt material when as part of a mattress cover it is fitted onto a mattress. The extended length, $L_w$, of the original 2.5-cm mark (with the weight in place) is measured and the total stretchability, % S, is calculated as a percentage of original length by the formula $\% S=100(L_w-2.5)/2.5$.

The "stretch force" required to remove or straighten the gathers in the edge region of a skirt fabric is measured as follows. The upper end of a 25-cm long, full width sample of skirt material is positioned and suspended from a 3-inch (7.6-cm) wide clamp so that the edge region under measurement is centered in the middle of the clamp. Ten centimeters below the upper end, a is load imposed through a hook placed in the middle of the width of the edge region. A spring scale (e.g., a "fish" scale) can be used conveniently for imposing and measuring the load. The load (measure in grams) is applied slowly so that the elongation (stretch) of the fabric edge region can be observed. When the gathered edge region is stretched so that the gathers are no longer present (i.e., the gathers are flattened), the load required to reach this flattened state is recorded. Repetitive measurements are made on the upper and lower edges of the skirt sample. The measurements reported herein were made on skirt material immediately after removal from a wound up supply roll of the material.

Preferred embodiments of the invention will now be described with reference to the drawing. FIG. 1 shows a mattress cover 10 which comprises a top panel 12 and a skirt 14. Top panel 12, preferably is a quilted padding material which optionally may include a water impermeable layer. Typically, top panel 12 is substantially inextensible and has dimensions which correspond to the dimensions of the top of the mattress that is to be covered. Skirt 14 is a bonded nonwoven material that preferably has a total stretch of less than 5% in the longitudinal direction. Skirt 14 also comprises upper edge region 18 and lower edge region 16. Elastic yarns are incorporated into both the lower edge region 16 and upper edge region 18 during the fabrication of the skirt fabric. Elastic yarns in lower edge region 16 serve to pull the bottom portion of skirt 14 underneath the mattress on which the cover is fitted. Upper edge region 18 provides a location for attaching (usually by sewing) skirt 14 to top panel 12. Surprisingly, a few elastic yarns in the upper edge region (compared to the number in the lower edge region) prevent the skirt material from excessive twisting, deforming and rolling out of plane when the skirt material is removed from a supply roll for attaching to the periphery of a top panel during manufacture of fitted cover. Typically, the stretch force required to flatten the gathers of the upper edge region is less than 15 percent, preferably in the range 2 to 10%, of that required to flatten the gathers of the lower edge region.

The elastic edge regions of skirt 14 can be produced with a conventional single-bar or multiple-bar stitchbonding machine of about 6 to 24 gauge, that typically forms 5 to 40 courses per inch (2 to 16 per cm). The stitchbonding machine is threaded to provide elastic yarns in the regions intended for edge regions 16 and 18, while the remainder (i.e., the mid-span region) of the sheet is not stitched. Typical nonwoven skirt fabrics of the invention have a unit weight in the range of 30 to 120 grams/square meter, preferably in the range of 40 to 70 g/m$^2$. After removal from the machine, the skirt fabric, in a relaxed condition, can weigh somewhat more than it does when formed on stitchbonding machine because of some gathering at the edges. Bonded nonwoven fabrics are particularly suitable for use in the skirt fabrics of the invention. Such fabrics are commercially available. For example, spunbonded CEREX® nylon, TYVEK® spunbonded olefin, spunbonded polypropylene of the type employed in the examples below, and the like.

The fabric employed to form the skirt of the fitted mattress cover typically is made of non-elastic fibers and has a uniform, smooth surface. Only the edge regions of the skirt fabric contain elastic yarns. The skirt fabric typically has a stretchability of less than 10%, preferably than 5%. In the finished skirt, the lower elastic edge region can stretch at least 50% from its relaxed length. Preferably, the longitudinal elastic stretch of the lower edge is in the range of 75 to 150%. The large elastic stretch of the lower elastic region permits easy installation of the finished mattress cover and provides good holding power of the skirt portion under the mattress.

A wide variety of cylindrical cores or mandrels is suitable for winding up the skirt material to form a skirt fabric package. Cylinders of cardboard, plastic or metal having a wide range constant diameters are satisfactory. For example, diameters in the range of 2 to 6 inches (5.1 to 15.2 cm), or larger or smaller, can be conveniently employed. As long as elastic regions of the skirt material provide a stretch force in the upper edge region that is less than 15% of the stretch force in the lower edge region, the skirt fabric does not exhibit excessive gathers or distortions and can be readily attached neatly to a top platform to complete a fitted mattress cover.

Figure 2:
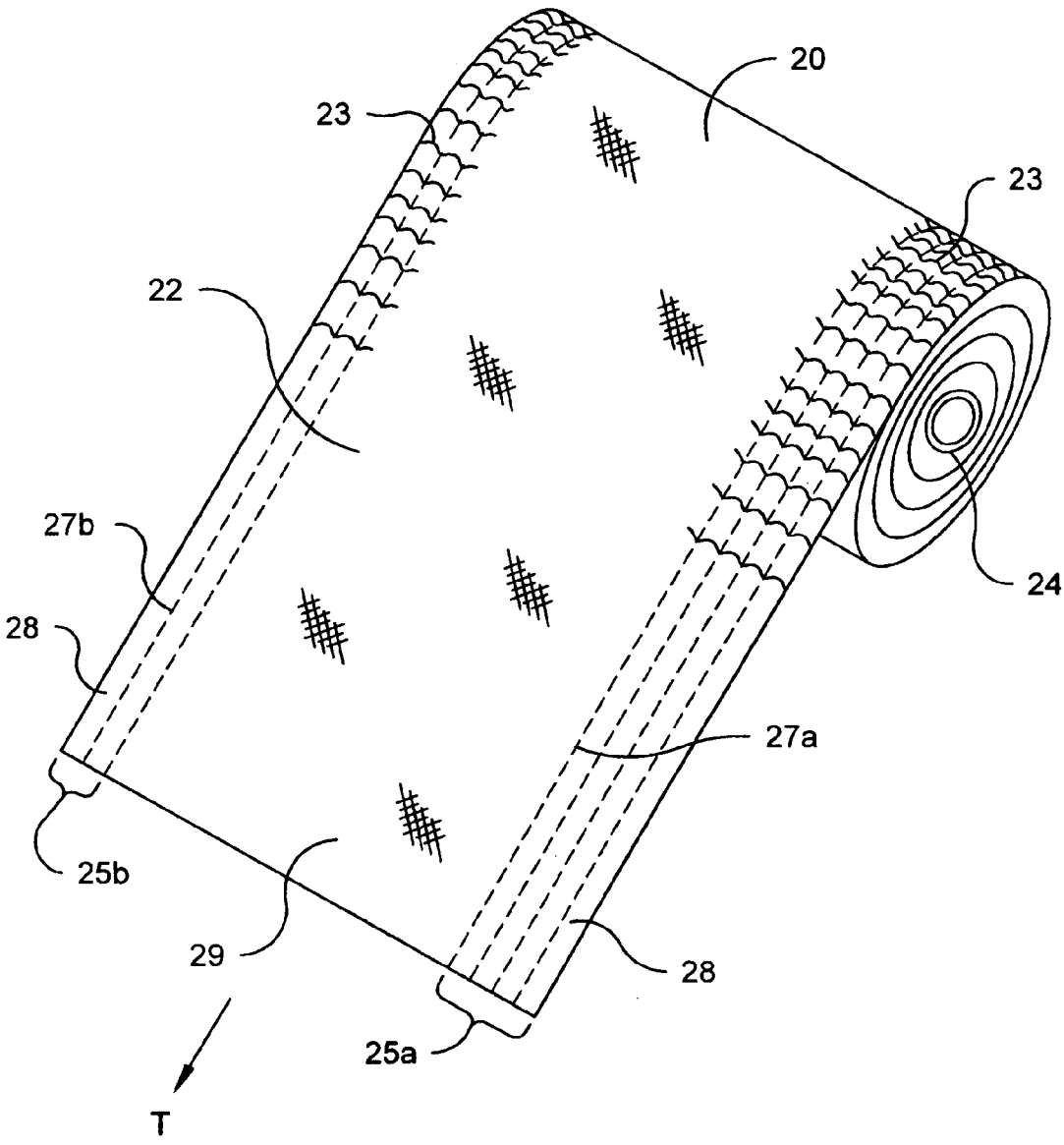
FIG. 2 is a perspective view of a fabric package in accord with this invention shown with fabric partially unwound from a roll on a core.

An embodiment of the novel fabric package 20 is shown in FIG. 2 to have a length of fabric 22 wound up on a cylindrical core 24 of uniform diameter. The fabric has a lower edge region 25*a* and an upper edge region 25*b* at opposite edges of fabric 22, the edge regions 25*a* and 25*b* being separated by a mid-span of fabric therebetween 29. The lower edge region and the upper edge region are stitched respectively with elastic elements 27*a* and 27*b*. The fabric can be unwound from the roll with tension T such that gathers 23 in the edge regions are removed as at 28 and such that the fabric being unwound from the roll is not excessively twisted, deformed or rolled out of plane.

A preferred skirt material and fitted mattress cover of the invention are fabricated with a bonded nonwoven skirt fabric by a process that comprises the following steps.

(a) A flat top panel is formed from a substantially non-stretchable fabric. The panel has a peripheral edge. Typically, the top panel is formed by quilt stitching two layers of material with a filling material between the two layers and then cutting the quilt-stitched material to correspond in size to the top of the mattress to which the cover is to be fitted.

(b) A bonded nonwoven skirt fabric is stitchbonded with elastic yarns threaded on one or more bars of a warp-knitting machine to form an elastic upper edge region and an elastic lower edge region with a non-stitched mid-span region in the skirt material. During the stitching of the edges, the elastic yarns are tensioned sufficiently to maintain the yarns in a substantially taut condition (e.g., extended to about 95% of the yarns' elastic limit) so that during the stitching, the tensioned yarns behave substantially like "hard" yarns (i.e., like non-stretch conventional drawn yarns of nylon or polyester). As a result of the stitching in this manner, the elastic yarns typically have a "residual stretch" in the range of about 2 to 10%, as calculated from the actual length of yarn fed and the theoretical length of the stitches knit therefrom. Suitable 6 to 24 gage machines capable of inserting 5 to 20 courses per inch (2 to 8/cm) are commercially available. Because such machines typically are several meters wide, several skirts can be formed simultaneously on the machine and wound up as individual packages or multiple packages on the same cylindrical core.

(c) The thusly formed skirt fabric is removed from the stitchbonding machine and allowed to contract in a direction parallel to the longitudinal edges of the skirt. The lower edge region of the skirt can contract to a length that is as small as one-third its non-contracted length (i.e., length prior to removal from the stitchbonding machine). The contraction occurs as a result of the release of the yarn tension that was applied during knitting and the further contraction that can occur when the fabric is washed and dried.

(d) Light tension is applied to at least the upper elastic edge region of the skirt fabric to stretch the upper longitudinal edge so that the upper edge of the skirt is attached to the peripheral edge of the top panel. During attachment, the upper edge may have residual stretch of as much as 10% without creating excessive attachment difficulties. The length of the skirt fabric while so stretched is equal to the peripheral length of the top panel. This type of attachment assures that the lower elastic edge region still will be able to be stretched longitudinally in the range of 10 to 100%. To complete the cover, the ends of the skirt fabric are usually sewn together at seam 19, as indicated in the drawing.

EXAMPLES

The following examples further illustrate the invention with the manufacture of bonded non-woven skirt material wound-up on a cylindrical core of 3-inch (7.6-inch) diameter and thereafter used to manufacture a fitted mattress cover.

In each example, skirt fabric was prepared by (a) feeding a 1.5-oz/yd$^2$ (51-g/m$^2$) bonded nonwoven sheet of spunbonded polypropylene fiber (i.e., commercial nonwoven sheet, Style 308155, obtained from Sommers, Inc of Coral Gables, Fla.) having a longitudinal and transverse stretchability of about 4%, to one 14 gage bar (i.e., 14 needles per 25 mm) of a LIBA stitchbonding machine, (b) stitching 8.8 stitches per inch (3.5/cm) with elastic yarns into the upper and lower edge regions along the length of the nonwoven sheet and then (c) winding the thusly prepared skirt material on a the cylindrical core. In each example, the elastic yarn was an elastic combination yarn, namely, a 140-denier (160-dtex) LYCRA® (spandex yarn, made by E. I. du Pont de Nemours & Co.) entangled with 40-filament 13-den (14-dtex) nylon yarn. The stitched material was wound up on the cylindrical core. Thereafter, a fitted mattress cover 10 (see the drawing) was made with the skirt fabric 14 by (a) cutting a 16.5-foot (4.88-meter) length of skirt fabric from the wound-up roll on the cylindrical roll, (b) placing the skirt material upper edge 18 under tension to remove any upper edge region gathers, (c) attaching the upper edge to the periphery of a top panel 12, and then (d) sewing the ends of the skirt fabric together at seam 19 to complete the cover.

In Example 1, the skirt was fabricated with an upper edge region containing 20% as much extended spandex yarn as contained in the lower edge region, and required only 8% of the tensile stretch force to flatten the gathers during attachment of the upper edge to the top panel. In Example 2, the skirt was fabricated with an upper edge region containing 14% as much extended spandex yarn as contained in the lower edge region, and required only 7.4% of the tensile stretch force to flatten the gathers during attachment to the top panel. The stretch force data are summarized in the table following the Examples.

For comparison with the mattress covers made with the skirt fabrics of Example 1 and 2, an attempt was made to fabricate a mattress cover with a third skirt sample of the same nonwoven material but with no elastic in upper edge region, the comparison showed that the absence of any elastic in the upper edge region, resulted in unsatisfactory windup of the skirt fabric on the roll, excessively precise control of yarn tension was required to attach to skirt to the upper panel of the mattress cover and if tension was released from the skirt prior to completion of the attachment, the skirt fabric gathered, twisted and rolled in a most undesirable fashion, which further impeded the manufacture of the mattress cover.

The inventor was most surprised that a very small amount of elastic yarn in the upper edge region of the skirt, having less than a tenth of the stretch force of the elastic yarn in the lower edge region, provided much easier and faster attachment of the skirt to the upper panel of the fitted mattress pad.

Example 1

Two rows of 1-0, 0-1, 1-2, 2-1 stitches, 0.071 inch (0.18 cm) apart, forming 8.8 courses per inch (3.5/cm) were inserted into the upper edge region of the bonded polypropylene skirt material by one bar of the stitchbonding machine threaded with two yarns per guide. The tension on the stitching yarn during insertion fully extended the yarn. The upper edge was thereby provided with a total of 312 denier (340 dtex) of extended LYCRA® elastic yarn.

The lower edge region of the skirt was prepared with 13 rows of yarns making the same stitch pattern as made with the upper region elastic yarns. For the lower edge region yarns, the needle bar was threaded at a lateral distance of 9 inches (22.9 cm) from the upper edge yarns guides with five rows of single end yarns per guide, followed by five rows with three yarns per guide. As with the upper edge region yarns, the tension on the stitching yarn during insertion fully extended the yarn and to provide with a total of 1560 den (1733 dtex) of extended LYRCRA® elastic yarn. The elastic yarns of the lower edge region filled a 0.71 inch (1.8 cm) width of the skirt material.

The lower edge region gathered when relaxed. The length of the lower edge region when held taut, was about 1.55 times its relaxed length. The length of the upper edge region as stitched (under tension) was about 1.3 times its relaxed length. Note, as summarized in the table below, the stretch force of the upper edge region was only 8% of that of the lower edge region, but was sufficient to prevent the skirt material from rolling out of plane and deforming to cause problems in forming a satisfactory wound up package on the cylindrical core or other handling problems in fabricating a fitted mattress cover with the skirt material.

Example 2

The same bonded nonwoven fabric and upper edge region elastic yarn stitching as were used in Example 1 were employed in this example. The lower edge and the mid-span regions differed from those of Example 1.

The lower edge region was formed at a lateral distance from the upper edge region along the bar of 13 inches (33 cm). The bar was threaded with eleven rows of single yarns per guide, followed by six rows of three yarns per guide. The lower edge covered a width of 1.21 inches (3.1 cm) and provided 2262 denier of extended LYCRA® spandex therein.

The lower edge region gathered when relaxed and had a ratio of length as-stitched (under tension) versus relaxed length of 2/1. The length ratio for the upper edge region was 1.3 to 1. As shown in the table below, the stretch force of the upper edge region was only 7.4% of that of the lower edge region. This small amount of elastic yarn was sufficient to prevent the skirt material from causing wind-up problems or difficulties in fabricating a fitted mattress cover with the skirt material.

TABLE

Force required to flatten gathers

| | Example 1 | Example 2 |
|---|---|---|
| Upper Edge Region (grams) | 10 | 10 |
| Lower Edge Region (grams) | 125 | 110 |
| Upper edge as % of lower edge | 8.0 | 7.4 |

Comparison Example

Skirt fabrics were prepared as in Examples 1 and 2, except that no elastic was inserted into the upper edge region of the skirt material. The comparison skirt materials could not be wound up satisfactorily on the cylindrical core because of excessive telescoping and could be attached to the periphery of the top panel of a mattress cover only with extraordinary care and very close tension control.

In contrast to the comparison samples, the skirt material of invention of Examples 1 and 2 formed satisfactory packages of wound up material on the cylindrical core. The packages had very little telescoping. The skirt material did not twist out of shape when cut and released from the package. Further, the skirt material from a package of the invention could be easily sewn into the periphery of the mattress cover top panel.

I claim:

1. A fabric package comprising a length of fabric wound up on a cylindrical core of uniform diameter, the fabric being a substantially non-stretchable bonded nonwoven fabric having a lower edge region, an upper edge region, and a mid-span there-between, the fabric having a unit weight in the range of 30 to 120 g/m$^2$, a stretchability of less than 10%, the lower edge region having elastic elements stitched therein under sufficient tension to extend the elastic elements to at least 200% of their non-tensioned length, and the lower edge region requiring a stretch force of at least 100 grams, to substantially remove gather from the lower edge when removed from the wound-up package, the upper edge region having elastic elements stitched therein such that the stretch force required to keep the upper edge region of the fabric from gathering, twisting and rolling out of plane when removed from the wound-up package, is no more than 15% of the stretch force required to prevent the lower edge region from gathering upon removal from the wound-up package, and the mid-span region having a width in the range of 7 to 20 inches.

2. A fabric package of claim 1 wherein the fabric unit weight is in the range of 40 to 70 g/m$^2$ and a stretchability of no more than 5%, the elastic yarns of the lower edge region requiring a stretch force in the range of 300 to 500 grams to prevent the lower edge region from gathering upon removal from the wound-up package, and the stretch force of the upper edge region is in the range of 2 to 10% of the stretch force of the lower edge region.

3. A fabric package of claim 1 wherein one or more widths of the fabric is wound up on a cylindrical core of 1 to 6 inches in diameter and 8 to 48 inches in length.

4. A fabric package of claim 1 wherein the lower edge region has a width in the range of 0.2 to 2 inches and the upper edge region has a width in the range of 0.05 to 0.5 inch.

5. A fabric package of claim 4 wherein the lower edge region has a width in the range of 0.5 to 1 inch and the upper edge region has a width in the range of 0.05 to 0.2 inch.

6. A fabric package comprising a length of fabric wound up on a cylindrical core of uniform diameter, the fabric being a substantially non-stretchable bonded nonwoven fabric having a lower edge region, an upper edge region, and a mid-span there-between, the fabric having a unit weight in the range of 30 to 120 g/m$^2$, a stretchability of less than 10%, the lower edge region having elastic elements stitched therein under sufficient tension to extend the elastic elements to at least 200% of their non-tensioned length, and the lower edge region requiring a stretch force of at least 100 grams, to substantially remove gather from the lower edge when removed from the wound-up package, the upper edge region having elastic elements stitched therein such that the stretch force required to keep the upper edge region of the fabric from gathering, twisting and rolling out of plane when removed from the wound-up package, is in the range of 2 to 15% of the stretch force required to prevent the lower edge region from gathering upon removal from the wound-up package, and the mid-span region having a width in the range of 7 to 20 inches.

7. The fabric package of claim 6 in which the fabric has fewer elastic yarns in the upper edge region than in the lower edge region.

8. A fabric package comprising a length of fabric wound up on a cylindrical core of uniform diameter, the fabric being a substantially non-stretchable bonded nonwoven fabric having a lower edge region, an upper edge region, and a mid-span there-between, the fabric having a unit weight in the range of 30 to 120 $g/m^2$, a stretchability of less than 10%, the lower edge region having elastic elements stitched therein under sufficient tension to extend the elastic elements to at least 200% of their non-tensioned length, and the lower edge region requiring a stretch force of at least 100 grams, to substantially remove gather from the lower edge when removed from the wound-up package, the upper edge region having elastic elements stitched therein such that the stretch force required to flatten gather of the upper edge region is in the range of 2 to 10% of that required to flatten the gather of the lower edge region, and the mid-span region having a width in the range of 7 to 20 inches.

* * * * *